US008220875B2

(12) United States Patent
Cipriani

(10) Patent No.: US 8,220,875 B2
(45) Date of Patent: Jul. 17, 2012

(54) ROAD PLANER FOR MILLING ROAD SURFACE

(75) Inventor: Antonio Cipriani, Alfonsine (IT)

(73) Assignee: Marini S.p.A. (IT)

( * ) Notice: Subject to any disclaimer, the term of this patent is extended or adjusted under 35 U.S.C. 154(b) by 26 days.

(21) Appl. No.: 12/880,843

(22) Filed: Sep. 13, 2010

(65) Prior Publication Data

US 2010/0327651 A1 Dec. 30, 2010

Related U.S. Application Data

(63) Continuation of application No. PCT/EP2008/001962, filed on Mar. 12, 2008.

(51) Int. Cl.
*E01C 23/088* (2006.01)

(52) U.S. Cl. ..... 299/39.2

(58) Field of Classification Search ..... 299/39.2
See application file for complete search history.

(56) References Cited

U.S. PATENT DOCUMENTS

| | | | | |
|---|---|---|---|---|
| 179,309 | A | 6/1876 | Hill | |
| 7,219,964 | B2 | 5/2007 | Berning et al. | |
| 2005/0179309 | A1 * | 8/2005 | Berning et al. | 299/39.2 |
| 2007/0122236 | A1 * | 5/2007 | Gaertner et al. | 404/93 |

FOREIGN PATENT DOCUMENTS

| | | | |
|---|---|---|---|
| DE | 10223819 | A1 | 12/2003 |
| DE | 102005035480 | A1 | 2/2007 |
| EP | 0971075 | A1 | 1/2000 |
| EP | 1507925 | B1 | 2/2006 |

OTHER PUBLICATIONS

International Preliminary Report on Patentability; PCT/EP2008/001962; Jul. 6, 2010; 7 pages.
International Search Report; PCT/EP2008/001962; Dec. 2, 2008; 2 pages.

* cited by examiner

*Primary Examiner* — John Kreck
(74) *Attorney, Agent, or Firm* — St. Onge Steward Johnston & Reens, LLC

(57) ABSTRACT

A self propelled road milling machine including: a chassis mobile on crawler-tracks; a milling drum supported by the chassis and located inside a drum housing; at least first and second conveying devices, supported by the machine chassis, receiving the material milled by the milling drum, and transporting it to a discharge point; a suction-filtering device of the air polluted by dust and vapors produced by the milling process; upper and side sealing mechanisms on the conveying devices, the sealing mechanisms being able to realize one continuous chamber above the conveying devices; suction device connected to the continuous chamber able to realize a maintained depression relative to the outside, the suction device being conceived for sucking the polluted air from the continuous chamber; a filtering unit to filter the polluted air, consisting of a battery of filtering elements, interposed between the continuous chamber and the suction device.

2 Claims, 7 Drawing Sheets

SECT. A-A

ROAD PLANER FOR MILLING ROAD SURFACE

CROSS-REFERENCE TO RELATED APPLICATIONS

The present application is a continuation of pending International patent application PCT/EP2008/001962 filed on Mar. 12, 2008 which designates the United States, the content of which is incorporated herein by reference.

FIELD OF THE INVENTION

The present invention relates to suction of dust and vapours in a road planer or similar milling machines.

In particular the invention refers to a road planer improved with suction and disposal devices for dust and vapours, namely the invention refers to a self propelled road milling machine comprising a chassis mobile on crawler-tracks/wheels, a milling drum supported by said chassis and located inside a drum housing, at least a first and a second conveying device, supported by the machine chassis, receiving the material milled by the milling drum and transporting it to a discharge point, a suction-filtering device of the air polluted by dust and vapours produced by the milling process, upper and side sealing means on said conveying devices, suitable to create on said conveying devices a single channel sealing means on the discharge area of the first conveying device onto the second conveying device.

BACKGROUND OF THE INVENTION

A known road planer refers to a self propelled milling machine, generally used for removing a portion of asphalt road pavement in order to restore the road with re-deposition of renovated road-surface (repaving).

In the present invention the definitions "road planer" and "milling machine" are considered equivalent.

The road planer or milling machine consists of a self propelled chassis, supported by crawler tracks, or wheels, generally equipped with hydraulic actuators, powered by a diesel engine and having a milling drum to mill the asphalt road surface for repaving.

A milling drum is supported by the chassis transversally to the direction of travel, being directly operated by the diesel engine through a mechanical transmission, or by a hydraulic transmission.

Said crawler tracks or wheels are connected to telescopic columns, which consent the chassis to achieve the correct height and attitude to get the requested milling profile.

The material, milled by the drum, is removed by one or more conveyor belts, and finally discharged at the front section of the machine, or at its rear section. In the first case the milled material is discharged into a transport vehicle, which precedes the milling machine, whilst in the second case the vehicle follows the milling machine, running backward.

During the milling operation dusts arise, caused by the partial crushing of the aggregates included in the road pavement; if the road pavement consists of an asphalt mixture also bitumen vapours are produced due to the high temperature caused by the friction of the cutting tools.

In an open-air milling machine dust and vapours escape from the drum housing and from the conveyor belts, being emitted into the surrounding environment generating pollution and particularly close to the driving platform with potential health risk for the operator.

The main object of the present invention is to improve functionality of the road planer or milling machine in order to reduce pollution and other inconveniencies.

Patent EP 0 971 075 A1 foresees to fit a suction hood over the collecting conveyor and to connect said hood with a cyclone followed by a suction ventilator: said cyclone being located in the rear part of the milling machine.

This solution presents the following evident disadvantages:

- the cyclone can knock down only the coarse dust particles, but it is not efficient at all in retaining the fine dust which is spread around in the atmosphere close to the operator's platform and sometimes close to the engine cooling air intake. The coarse dust is discharged onto the ground thus increasing the amount of material to be removed to clean the milled surface.
- the poor efficiency of the cyclone causes the ventilator to suck still dust-laden air which compromises the functionality of the unit in a short time.

Patent DE 102 23 819 A1 foresees the suction of the polluted air from the channel on the collecting conveyor and to convey it into the channel on the loading conveyor by means of the same suction-ventilator. This solution consents to exhaust the air, polluted by dust and vapours, into the atmosphere far away from the operator's platform. However the solution suffers the following disadvantages:

- the ventilator sucks dust-laden air which compromises the functionality of the unit in a short time.
- no filtering system is foreseen able to agglomerate the dust and to limit its diffusion into the atmosphere.

DE 10 2005 035 480 discloses a milling machine comprising a dust box arranged in front of a ventilator and assigned to a suction channel having an outlet for passing clean waste air directly into the atmosphere.

U.S. patent application Ser. No. 2005/0179309 discloses a milling machine with a suction device for the polluted air, whereby the milled material is enclosed by a channel, the suction device is connected to a rear channel section of the channel in the direction of the material transport and sucks off the air polluted during milling blowing off the cleaned air into the environment.

Patents EP 1 507 925 B1 and U.S. Pat. No. 7,219,964 B2 foresee to suck the polluted air from both the channel on the collecting conveyor and from the channel over the loading conveyor, where:

- the collecting conveyor is equipped with a sealing device, consisting of sets of flexible flaps, located close to its discharge head, which oppose to the entry of external air but do not oppose to the flow of the milled material;
- the channel on the collecting conveyor is connected to the corresponding channel on the loading conveyor by means of hoses with air intakes located upstream of the above mentioned sealing device;
- sealing devices, consisting of sets of flexible flaps are provided for the loading conveyor such as for the collecting conveyor. On the loading
- conveyor the sealing devices are located downstream of the connection points of the above hoses with the loading conveyor channel and downstream of the suction-filtering unit;
- the discharge area of the collecting conveyor onto the loading conveyor is not involved in the suction of the polluted area;
- the polluted air is forced to pass through a filtering unit before being exhausted by the suction-ventilator into the atmosphere.

The disadvantages of the solution are the following:

the bulk hoses connecting the channels of the two conveyors and the movements of said hoses caused by the slewing of the loading conveyor, compromise functionality;

the discharge area of the collecting conveyor onto the loading conveyor is not interested by the suction process. In said area dust and vapours are emitted and spread into the atmosphere in the vicinity of the operator's platform.

SUMMARY OF THE INVENTION

The scope of the invention is to obviate the above disadvantages and to realize a more sure and simple milling machine, namely a road planer having improved performance to avoid pollution and damages on surroundings.

The object is achieved by provision of a self propelled road milling machine comprising a chassis mobile on crawler-tracks/wheels, a milling drum supported by said chassis and located inside a drum housing, at least a first and a second conveying device, supported by the machine chassis, receiving the material milled by the milling drum and transporting it to a discharge point, a suction-filtering device of the air polluted by dust and vapours produced by the milling process, upper and side sealing means on said conveying devices, suitable to create on said conveying devices a single channel sealing means on the discharge area of the first conveying device onto the second conveying device.

The sealing means realize one continuous chamber above the conveying devices and in the joint connections area among them. The joint between the first chamber and the secondary chamber/s being an articulated sealed joint, the continuous chamber extends continuously from the milling drum area up to the discharge head. The continuous chamber being free from external air-channellings between the first chamber and the second chamber/s, the continuous chamber being formed by: sidewalls of the milling drum housing, rear mouldboard, and side plates.

A first chamber enclosing the first conveying device, being this chamber formed by the side sealing means, the flexible means, top sealing mean above the conveyor belt, and the first chamber being closed and sealed on its lower part by the conveyor belt, being further provided with sealing junction flexible means on sliding contact with the upper part of the continuous belt of the conveying device, the junction being elastic.

One or more secondary chambers enclosing a secondary conveying device, being this chamber formed by the side sealing means, the flexible means, the top sealing means, and the first chamber being closed and sealed on its lower part by the conveyor belt, being further provided with sealing junction flexible means on sliding contact with the upper part of the continuous belt of the conveying device, the junction being elastic.

At least one sealing means and at least one sealing means enclosing an intermediate area being this area the discharge area of the first conveying device and the charge area of the second conveying device.

Two or more sets of sealing means on the top end of the continuous chamber fixed to the top sealing means. The sealing means being flexible flaps overlapping one with the other, the sets of flexible sealing means being free to slide on their side in correspondence to the sealing means and being free to slide on their bottom side in correspondence to the upper part of continuous belt and/or flow of the milled material carried by the mobile rubber belt itself. The sets of flexible sealing means being foldable upwards and externally to the secondary chamber by the flow of the milled material and being conceived in such a way that they are kept in contact one with the other and with the flow of the milled material itself by the depression induced by the suction device.

The suction-filtering device is located on the second chamber which is closer to the self propelled road milling machine body. The suction-filtering device comprises:

a suction device connected to the continuous chamber able to realize a maintained depression into the continuous chamber in respect of the outside, the suction device being conceived for sucking the polluted air from the continuous chamber and being connected to, the suction device being a radial centrifugal ventilator.

a filtering unit to filter the polluted air sucked from the suction device consisting of a battery of filtering elements, functionally interposed between the continuous chamber and the suction device. The number of filtering elements in the battery of filtering elements being greater then 4 and lower then 12, one being closed to the other and extending horizontally and parallel one to the other. The filtering elements being fitted transversally to the longitudinal centre line of the conveying device supporting them.

a side collecting duct collecting the air from each of the filtering elements, the side collecting duct is hinged and openable.

a collector, connected to the suction device collecting the air from the collecting duct.

a cleaning device for the filtering elements periodically pulsing blows of compressed air in contra-flow. The compressed air to each of the filtering elements being distributed by a side conduit and/or a cleaning device for the filtering elements periodically mechanically shaking or vibrating the filtering elements. The dust cake which is formed in said filtering elements disposed by the cleaning devices falling onto the conveying device placed below.

one or more protection nets in the continuous chamber above the advancing material on the upper part of the continuously advancing belt.

With this solution a no-pollutant, better performing road planer is realized.

The invention will be better understood with the following description.

BRIEF DESCRIPTION OF THE DRAWINGS

The features of the present invention are set forth in particulars in the appended claims. The invention itself, together with further features and attendant advantages, will become apparent from consideration of the following detailed description, taken in conjunction with the accompanying drawings.

An embodiment of the invention is now described, by way of example only, with reference to the accompanying drawings in which.

DETAILED DESCRIPTION OF THE INVENTION

Figure 1:
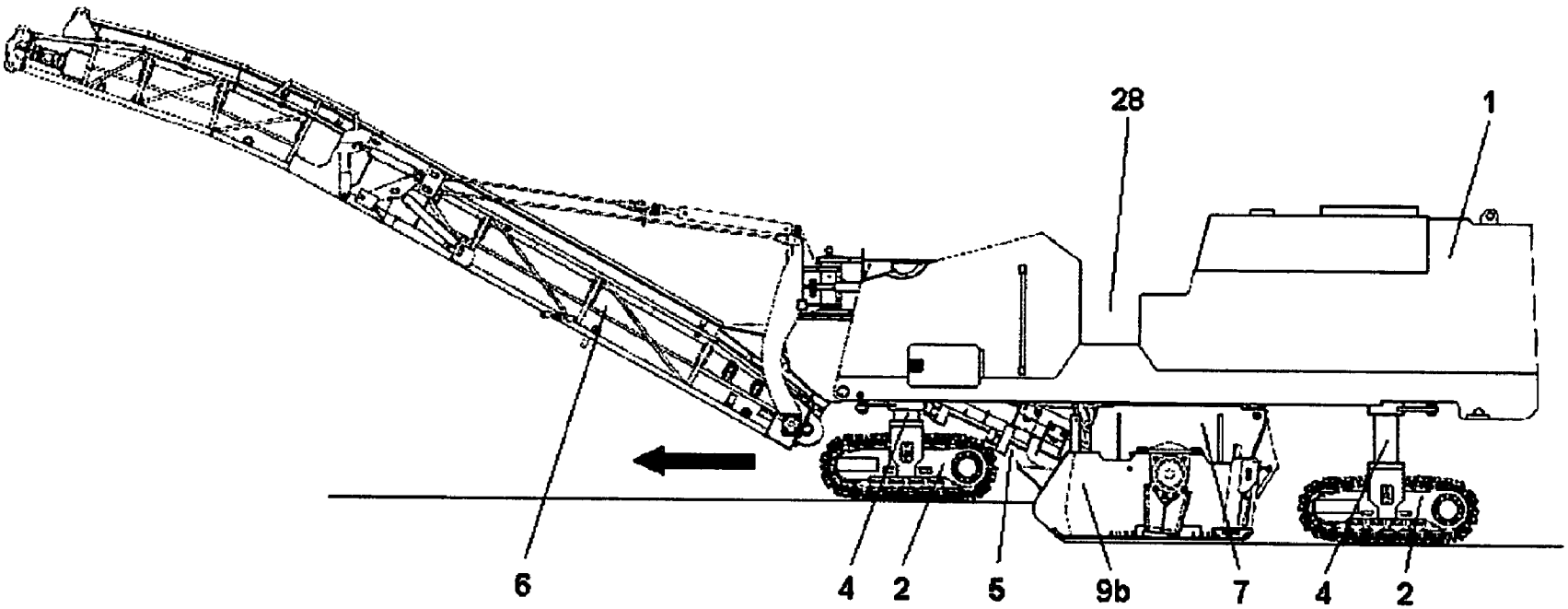
FIG. 1 discloses a side view of a planer of known type.
Figure 2:
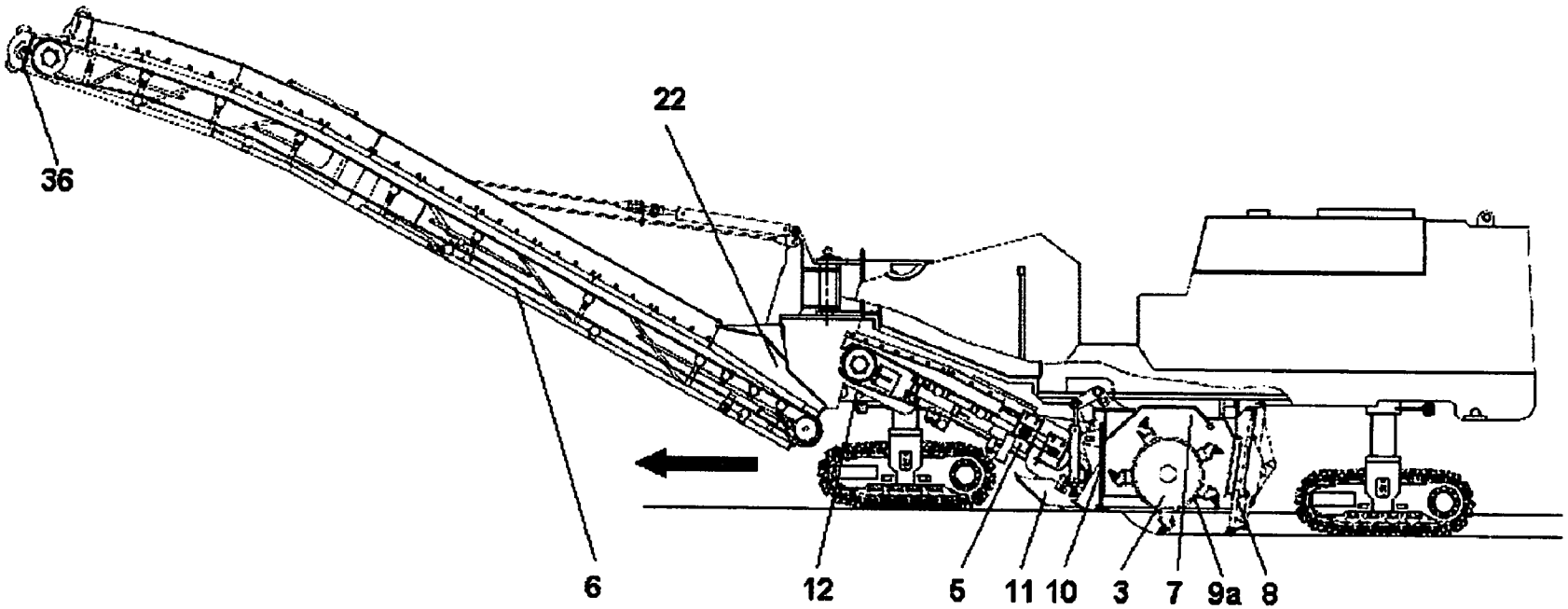
FIG. 2 discloses a longitudinal view of a planer of known type.

The machine of FIG. 1, FIG. 2 consists of a self propelled chassis (1), supported by crawler tracks (2), generally equipped with hydraulic actuators, powered by a diesel engine.

A milling drum (3) is supported by the chassis (1) transversally to the direction of travel, being directly operated by the diesel engine through a mechanical transmission, or by a hydraulic transmission.

The crawler tracks (2) are connected to telescopic columns (4), which consent the chassis to achieve the correct height and attitude to get the requested milling profile.

The material, milled by the drum (3), is removed by one or more conveyor belts (5), (6) and is finally discharged at the front section of the machine (in another solution this can be at its rear section). In the present case the milled material is discharged into a transport vehicle which precedes the milling machine, whilst in the opposed case the vehicle follows the milling machine, running backward.

The milling drum (3) is located inside a drum housing (7). With reference to the work driving direction, said drum housing (7) is provided with a rear mobile moulder (8), fitted with scraping tools, and with two mobile side plates (9*a*), (9*b*), kept in contact with the road surface, and having a floating or a slightly downward forced action.

In the front section of the milling drum housing (7) an opening (10) is provided, which consents the milled material to be discharged onto a first conveyor belt (5) (collecting conveyor). Said collecting conveyor (5) is provided at its driven pulley section with a support device (11) (pressure bar), generally sliding over the road surface, in contact with the same. The driving pulley section of said collecting conveyor (5) slides over a support (12) which is part of the machine chassis (1). As a consequence the frame of the collecting conveyor (5) moves vertically and longitudinally, depending upon the working milling depth.

The collecting conveyor (5) discharges the milled material onto a second conveyor belt (6) (loading conveyor) which can be slewed vertically and horizontally to adapt its discharge head (36) to the height and position of the transport vehicle.

Figure 5:
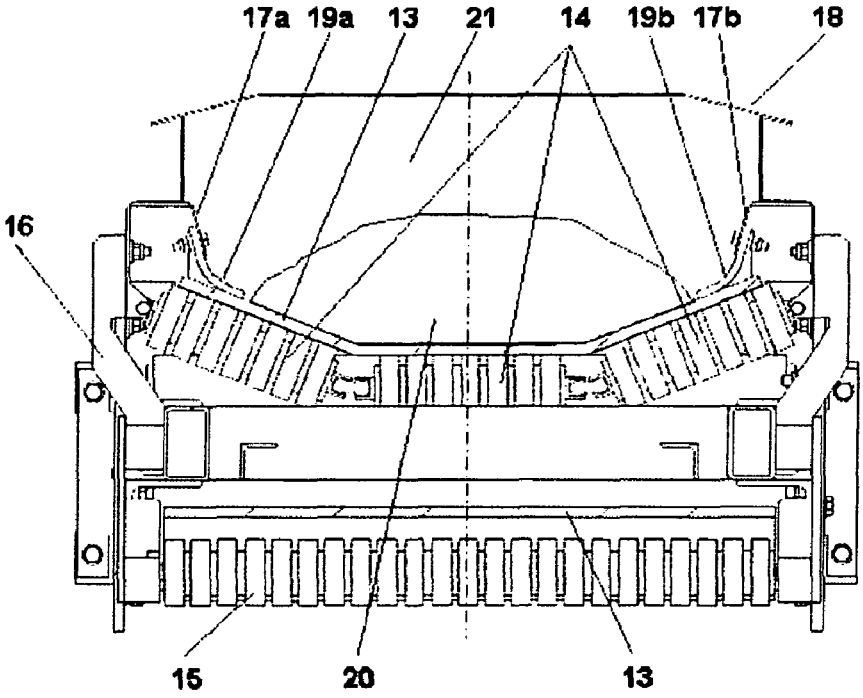
FIG. 5 discloses a section view of a typical conveyor belt.

The typical section view of the conveyor belts, of known technology, is schematically shown in FIG. 5. Each conveyor consists of a mobile rubber belt ring (13), supported in the transport section by "V" shaped rollers (14) and supported by other rollers (15) in the return section. The frame (16) of the conveyor is fitted with side walls (17*a*), (17*b*) and with a cover (18). Said side walls (17*a*), (17*b*) support flexible skirts (19*a*), (19*b*) in positive contact with the upper surface of the rubber belt (13). The milled material is therefore transported inside a channel (21) enclosed by said walls (17*a*), (17*b*), (19*a*), (19*b*), by said cover (18) and by said mobile rubber belt (13).

During the milling operation dusts arise, caused by the partial crushing of the aggregates included in the road pavement.

If the road pavement consists of an asphalt mixture also bitumen vapours are produced, due to the high temperature caused by the friction of the cutting tools, so dust and vapours escape from the drum housing and from the conveyor belts and are emitted into the surrounding environment and particularly close to the driving platform (28) with potential health risk for the operator.

Figure 3:
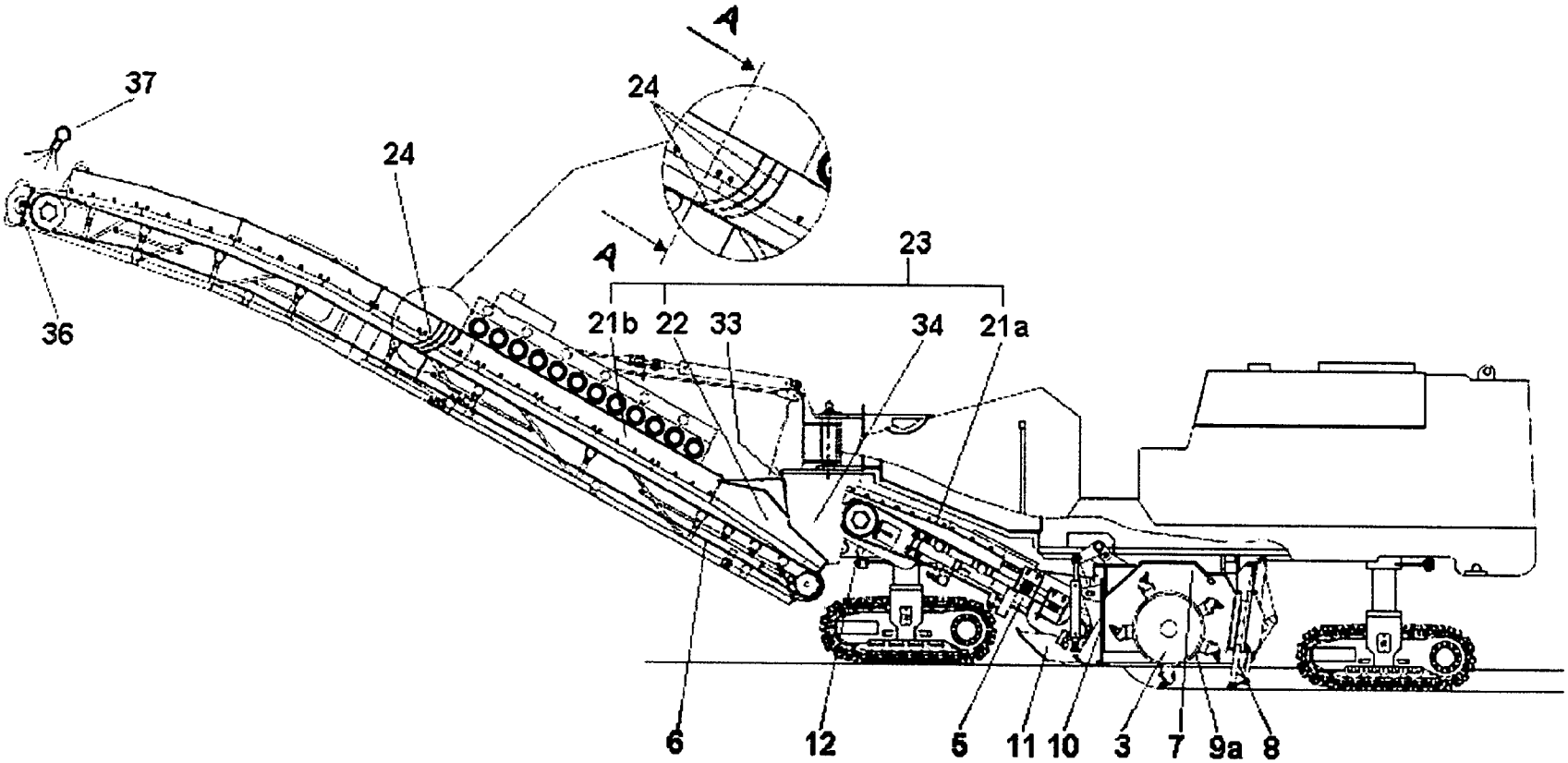
FIG. 3 discloses a longitudinal section view of the planer of the present invention.
Figure 4:
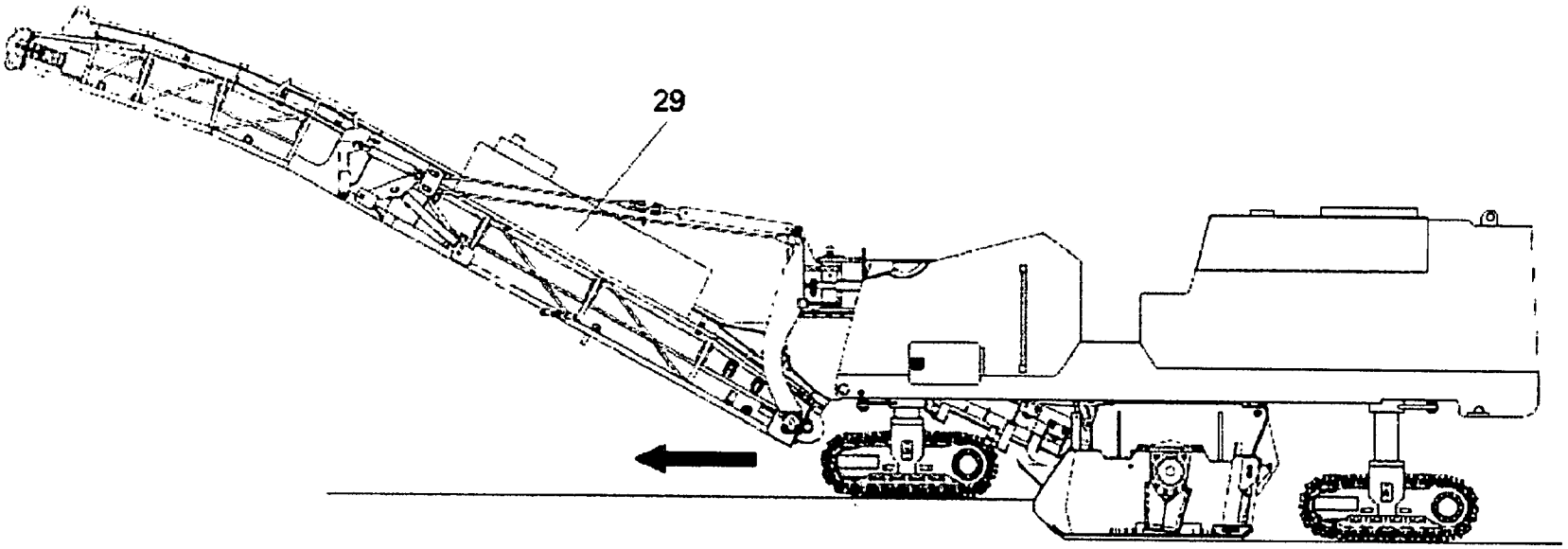
FIG. 4 discloses a side view of the planer of the present invention.

The description of the invention refers to a road planer improved with suction and disposal devices for dust and vapours as for FIG. 3 and FIG. 4, where the milling drum (3) is located inside a drum housing (7) and where the suction-filtering unit (29) is located over the loading conveyor (6).

With reference to FIG. 3-6 the invention concerns the continuity of channel (21*a*) and (21*b*), respectively identifiable on conveyors (5) and (6), and the effective sealing of the discharge area (22) of the collecting conveyor (5) onto the loading conveyor (6). Said channels (21*a*), (21*b*) on conveyors (5), (6) and the discharge area (22) of conveyor (5) onto conveyor (6), constitute one continuous channel (23).

Said channel (23) is closed in its lower section by the walls of the milling drum housing (7), by the rear mouldboard (8) and by the side plates (9*a*), (9*b*), whilst its upper section is closed by one or more sets of overlapped flexible flaps (24), which oppose the entry of external air but do not oppose the flow (20) of the milled material. Said flexible flaps (24) slide over the milled material (20) in contact with it.

Said channel (23) is kept in depression by a suction device (25), preferably consisting of a radial centrifugal ventilator.

Said ventilator (25) sucks the air polluted by dust and vapours from said channel (23) through a filtering device (30), consisting in a battery of filtering elements (26) (pockets, hoses, cartridges).

Said filtering elements (26) are generally, but not necessarily, individually supported by an internal frame which prevents the filtering element from being squashed by the differential pressure existing between the external and the internal surfaces of the filtering medium.

The polluted air is forced to pass through the filtering elements (26) whilst the dust is retained on their external surfaces forming a cake.

This solution advantageously prevents the suction ventilator (25) from being crossed by dust-laden air which would affect the efficiency of the unit in a short time.

While in the drawings reference is made to a preferred solution with a battery of eight filtering elements, it will be apparent to experts in the art that different configurations with more or fewer filtering elements can be used.

Said battery of filtering elements (26) is advantageously disposed over said conveyor (6), the filtering elements (26) being subsequently disposed one after the other longitudinally to said conveyor (6).

A protection net (27) is also advantageously provided between the flow (20) of the milled material and the filtering elements (26). Said net (27) prevents the milled material from bouncing against the filtering elements (26) and reduces the risk of damage to a minimum.

During the milling operation the dust accumulates on the external surface of the filtering elements forming a sticking layer, the thickness of which tends to oppose the continuity and efficiency of the air suction.

Said dust layer is periodically removed by means of known techniques, which use pulse jets (35) of compressed air into the filtering elements (26), or vibrating devices to shake them.

Figure 6:
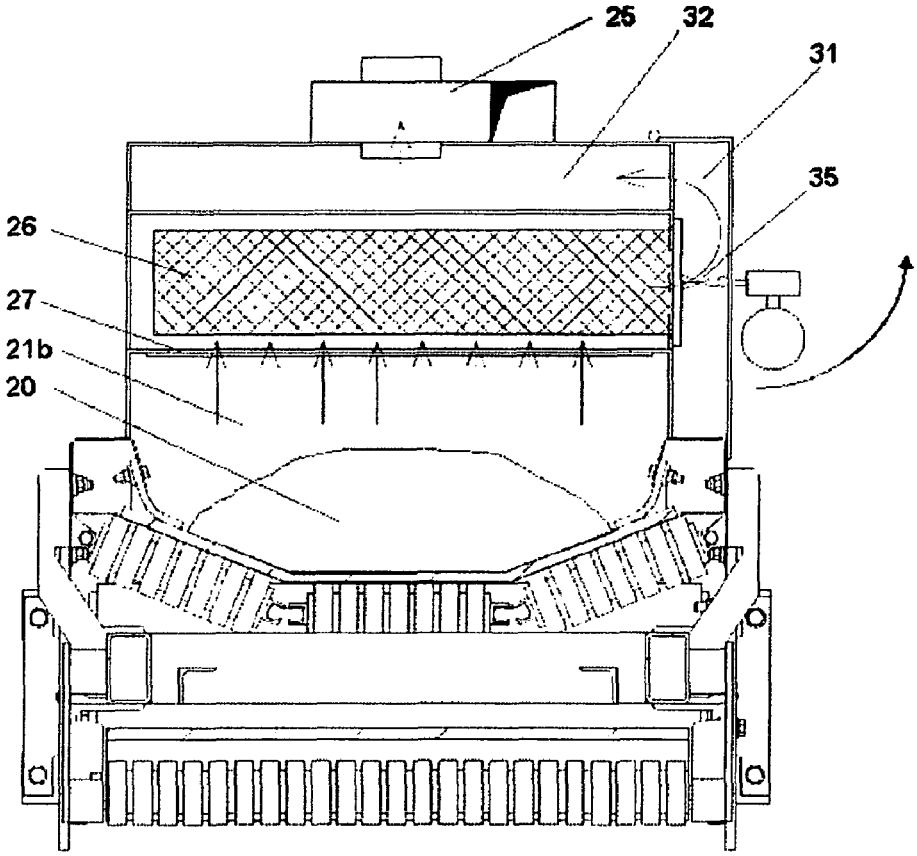
FIG. 6 discloses a section view of the conveyor belt equipped with the filtering-suction group of the present invention.
Figure 7:
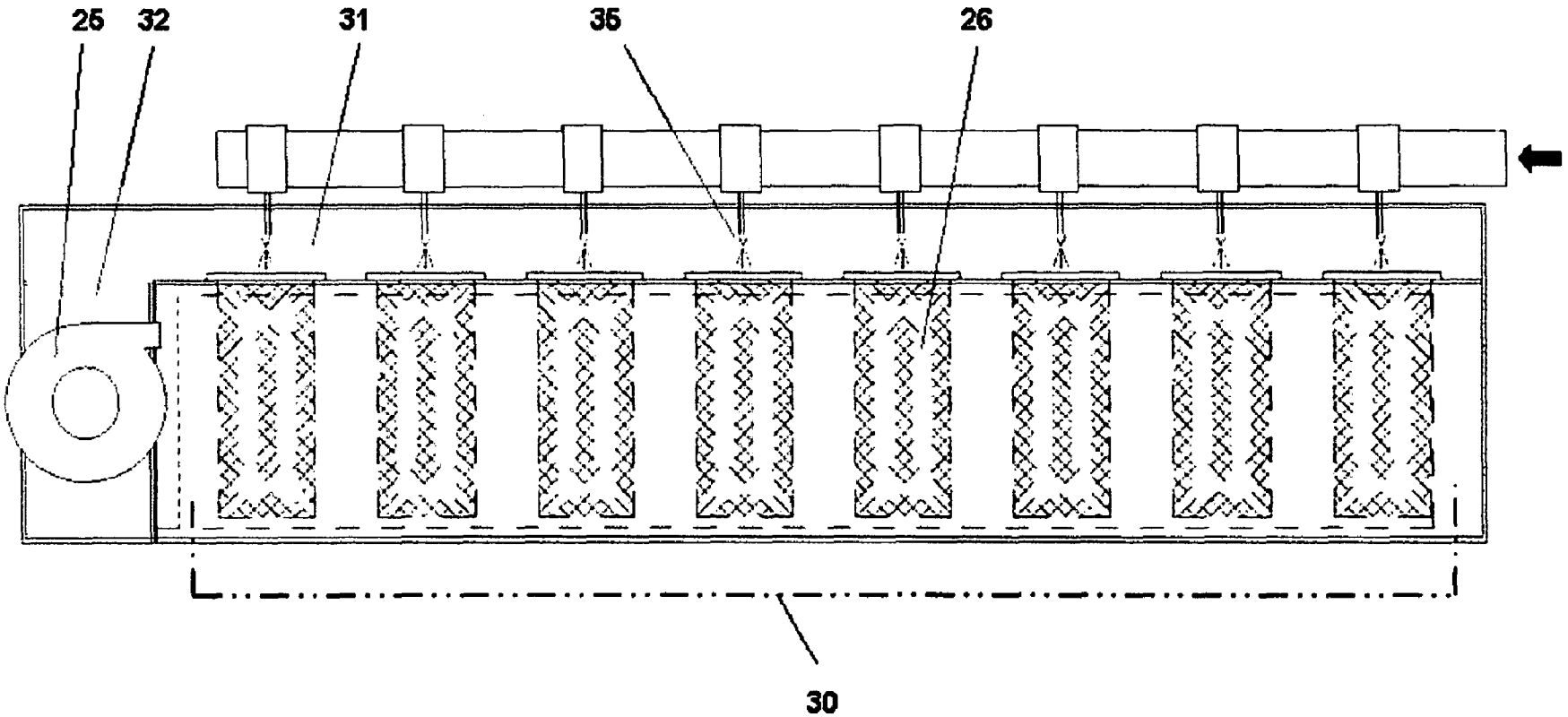
FIG. 7 discloses a schematic top view of the filtering-suction group.

With reference to FIG. 6 and FIG. 7, said pulse jets (35) are distributed to each filtering element (26) by a conduit (38) running parallel to the longitudinal arrangement of said filtering elements (26). It will be apparent to experts in the art that different but equivalent configurations can be used.

The dusts removed from the filtering elements are efficaciously agglomerated and drop onto the milled material flow (20) carried by the loading conveyor (6), to be finally jointly discharged onto the transport vehicle.

At the discharge head (36) of the loading conveyor (6) other dust is inevitably produced, which however spreads around in the atmosphere far away from the operator's platform (28).

Close to the discharge head (36) of the loading conveyor (6) a spray bar (37) is provided. Said spray bar (37), consists of a set of water atomizing nozzles, having the scope to further support the dust agglomeration and its fall.

The suction efficiency depends upon the sealing degree of channel (23). In particular the sealing media of the critical discharge area (22) of the collecting conveyor (5) onto the loading conveyor (6) must be efficient enough so as to maintain the channel (23) depressurized at any position of conveyor (6) in respect of conveyor (5) and at any position of conveyor (5) in respect of the machine chassis (1).

The sealing means of the discharge area (22) of the collecting conveyor (5) onto the loading conveyor (6) are preferably made as schematically shown in FIG. 3, where:

the sealing device (33) compensates the vertical slew of the loading conveyor (6), the sealing device (34) compensates the horizontal slew of the loading conveyor (6).

Figure 8:
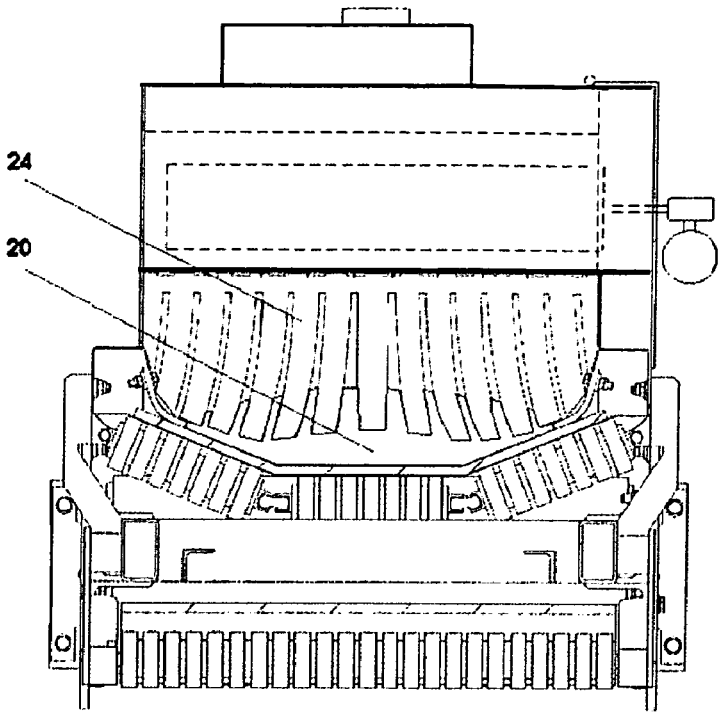
FIG. 8 discloses a section view according to A-A in FIG. 3.
Figure 9:
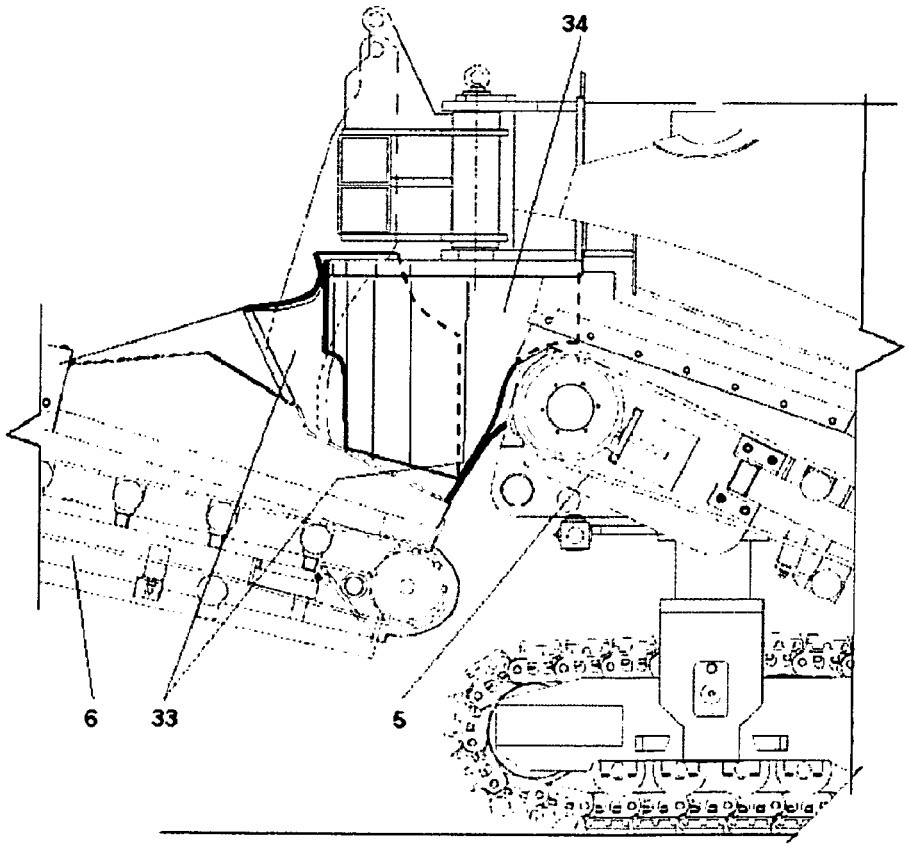
FIG. 9 discloses a section view of the sealing devices in the discharge zone of the collecting conveyor onto the loading conveyor.

A preferred solution of the filtering-suction group (25), (30) is schematically shown in FIG. 6, FIG. 7 and FIG. 8.

The air, polluted by dusts and vapours produced by the milling operation, is sucked from the inside of the aforementioned channel (23), which forms a continuous connection between the drum housing (7) and the filtering-suction group (25), (30), said filtering-suction group (25), (30) being directly installed over the lower section of the frame of the collecting conveyor (6).

The suction, supported by the ventilator (25), produces a depression inside the channel (23), which causes a continuous intake of external air and prevents the polluted air from escaping.

The polluted air first passes through the protection net (27) and then through the filtering elements (26); said filtering elements (26) being preferably fitted horizontally and transversally to the longitudinal centre line of the loading conveyor (6).

The filtering elements (26) oppose a resistance to the air flow, which results in a pressure drop through the filtering media. This forces the dust to be retained on the external surface of the filtering elements (26), causing a slight compression of the dust and its agglomeration. The dust cake itself contributes to increase the pressure drop through the filtering elements, thus improving the dust agglomeration.

An automatic cleaning system (35), of known technology, periodically pulses blows of compressed air in contra-flow to detach the dust cake and makes it to drop onto the milled material flow (20). Only the dust particles with a size of a few microns and part of the asphalt vapours can pass through the filtering media and are not retained.

Said filtering-suction group (29) is advantageously located over the secondary chamber (21*b*) so that during the cleaning procedure of the filtering elements (26), the dusts removed from them drop directly on the loading conveyor (6), being then carried to the discharge head together with the milled material flow (20).

Said filtering-suction group (29) is advantageously located in correspondence of the lower section of the frame of the collecting conveyor (6), namely the section of the frame which is closer to the self propelled road milling machine body, so that the weight of the filtering-suction group does not bear down on the top end of the frame itself arising stability problems.

The filtered air is conveyed into a side collecting duct (31) and then into a collector (32), connected to the suction ventilator (25). Said side collecting duct (31), can be advantageously opened to remove the filtering elements for maintenance operation.

The negligible amount of dust, still remaining in the filtered air flow, does not affect in any way the efficiency of the system and the work continuity of the machine.

Advantageously said sets of flexible sealing means (24) applied at the end top of the second conveyor are made of a plurality of closed vertical straps in which each strap overlaps with its border the adjacent one. In this way the advancing material on the continuous belt does not create openings between said straps deflected upwards by the variation in size of the continuous advancing material (20).

The invention claimed is:

1. A self propelled road milling machine comprising:

a chassis, a milling drum supported by said chassis and located inside a drum housing, at least a first and a second conveying device, supported by the chassis, for receiving the material milled by the milling drum, and transporting it to a discharge point, a suction-filtering device or filtering the air polluted by dust and vapours produced by the milling process, side walls, flexible skirts, and covers around said conveying devices, suitable to create on said conveying devices a single channel a vertical sealing device and a horizontal sealing device on the discharge area of the first conveying device onto the second conveying device, wherein:

one continuous chamber is formed above said first and second conveying devices and in the joint connections area between them, said continuous chamber extends continuously from the milling drum area to a discharge head, and said continuous chamber is free from external air-channellings, said continuous chamber being formed by:

sidewalls of the milling drum housing, a rear mouldboard, side plates, a first chamber enclosing the first conveying device, being the chamber formed by a first set of side walls, a first set of flexible skirts, and a first cover above a first conveyor belt, and said first chamber being closed and sealed on its lower part by the first conveyor belt, wherein said first set of flexible skirts form a sealing junction on sliding contact with the upper part of the first conveyer belt of said first conveying device, said junction being elastic, at least one second chamber enclosing a second conveying device, being the chamber formed by a second set of side walls, a second set of flexible skirts, and a second cover, and said second chamber being closed and sealed on its lower part by a second conveyor belt, wherein said flexible skirts form a sealing junction on sliding contact with the upper part of the second conveyer belt of said second conveying device, said junction being elastic, said vertical sealing device and said horizontal sealing device enclosing the discharge area of the first conveying device and the charge area of the second conveying device and forming an articulated sealed joint, and at least two sets of flexible flaps in the continuous chamber fixed to the second cover, wherein each of the flexible flaps overlaps with at least one other of the flexible flaps, said sets of flexible flaps are free to slide on their side relative to said side walls and are free to slide on their bottom relative to said upper part of the second conveyer belt or flow of the milled material carried by the second conveyer belt, said sets of flexible flaps being foldable upwards within said second chamber by the flow of the milled material and being conceived in such a way that they are kept in contact one with each other and with the flow of the milled material itself by an air-pressure depression induced by the suction-filtering device, and further wherein said suction-filtering device is located on the second chamber, said suction-filtering device comprising:

suction device connected to said continuous chamber able to create and maintain an air-pressure depression in said continuous chamber relative to the outside, said suction device being provided for sucking the polluted air from said continuous chamber and including a radial centrifugal ventilator, a filtering unit to filter the polluted air sucked from said suction device comprising a battery of filtering elements, functionally interposed between said continuous chamber and said suction device, the number of filtering elements in said battery of filtering elements being greater then 4 and lower then 12, one being closed to the other and extending horizontally and parallel one to the other, said filtering elements being fitted transversally to the longitudinal centre line of said second conveying device supporting them, a side collecting duct collecting the air from each of said filtering elements, said side collecting duct is hinged and openable, a collector, connected to said suction device collecting the air from said collecting duct, a cleaning device for said filtering elements periodically pulsing blows of compressed air in contra-flow, the compressed air to each of said filtering elements being distributed by a side conduit or a cleaning device for said filtering elements periodically mechanically vibrating said filtering elements, the cleaning device thereby causing the dust cake which is formed in said filtering elements to fall onto the second conveying device, at least one protection net in the continuous chamber above the flow of milled material on the second conveyer belt.

2. The self propelled road milling machine according to claim 1, further comprising at least one water spray bar at the discharge head of the second conveyor belt.

* * * * *